US006790046B2

(12) United States Patent
Haffenden et al.

(10) Patent No.: US 6,790,046 B2
(45) Date of Patent: Sep. 14, 2004

(54) ACCESSORY FOR A PORTABLE ELECTRONIC DEVICE

(75) Inventors: Ian David Haffenden, Winchfield (GB); Keith Johnson, North Ascot (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/153,774

(22) Filed: May 24, 2002

(65) Prior Publication Data

US 2002/0177330 A1 Nov. 28, 2002

(30) Foreign Application Priority Data

May 25, 2001 (GB) ..... 0112825

(51) Int. Cl.[7] ..... H01R 39/00

(52) U.S. Cl. ..... 439/6; 439/13; 439/669; 439/248; 455/466

(58) Field of Search ..... 439/446, 6, 668, 439/669, 246, 248, 11, 13; 455/566

(56) References Cited

U.S. PATENT DOCUMENTS

| | | | | | |
|---|---|---|---|---|---|
| 4,227,765 | A | * | 10/1980 | Neumann et al. | 439/246 |
| 4,697,859 | A | * | 10/1987 | Fisher, Jr. | 439/246 |
| 4,773,866 | A | * | 9/1988 | Basques | 439/21 |
| 4,845,603 | A | * | 7/1989 | Shpigel | 439/6 |
| 4,941,836 | A | * | 7/1990 | Bormuth | 439/246 |
| 5,205,755 | A | | 4/1993 | Douty et al. | 439/247 |
| 5,380,219 | A | * | 1/1995 | Klier | 439/446 |
| 5,419,707 | A | * | 5/1995 | Kelley | 439/6 |
| 5,641,294 | A | | 6/1997 | Beard | 439/63 |
| 5,746,617 | A | * | 5/1998 | Porter, Jr. et al. | 439/248 |
| 5,808,672 | A | * | 9/1998 | Wakabayashi et al. | 361/737 |
| 6,406,313 | B1 | * | 6/2002 | Victor | 439/578 |
| 6,424,761 | B1 | * | 7/2002 | Kordahi et al. | 385/25 |
| 6,424,843 | B1 | * | 7/2002 | Reitmaa | 455/566 |

FOREIGN PATENT DOCUMENTS

| | | |
|---|---|---|
| EP | 0 159 116 A2 | 10/1985 |
| GB | 943128 | 11/1963 |
| GB | 2 128 038 A | 4/1984 |
| GB | 2 193853 A | 2/1988 |

OTHER PUBLICATIONS

US 20030174848A1 patent application Publication.*

* cited by examiner

*Primary Examiner*—P. Austin Bradley
*Assistant Examiner*—Briggitte R. Hammond
(74) *Attorney, Agent, or Firm*—Antonelli, Terry, Stout & Kraus, LLP

(57) ABSTRACT

An accessory for attachment to a portable electronic device is disclosed. The accessory has a housing, a connector, extending from the housing for electrically connecting the accessory to the portable electronic device, and circuitry located in the housing and electrically connected to the connector. The connector is mounted in the housing and is arranged to be movable with respect to the housing. The accessory is particularly exemplified by a plug in camera accessory for a portable telephone.

21 Claims, 3 Drawing Sheets

ACCESSORY FOR A PORTABLE ELECTRONIC DEVICE

BACKGROUND OF THE INVENTION

Field of the Invention

This invention relates to an accessory for a portable electronic device. It finds particular, but not exclusive, utility in the field of portable telephony, where different accessories may be attached to a portable telephone.

SUMMARY OF THE INVENTION

According to a first aspect of the present invention there is provided an accessory for attachment to a portable electronic device comprising: a housing; a connector, extending from the housing for electrically connecting the accessory to the portable electronic device; circuitry located in the housing and electrically connected to the connector, wherein the connector is mounted in the housing and is arranged to be movable with respect to the housing.

BRIEF DESCRIPTION OF THE DRAWINGS

For a better understanding of the present invention, and to understand how the same may be brought into effect, the invention will now be described, by way of example only, with reference to the appended drawings in which:

DESCRIPTION OF THE PREFERRED EMBODIMENTS

Figure 1:
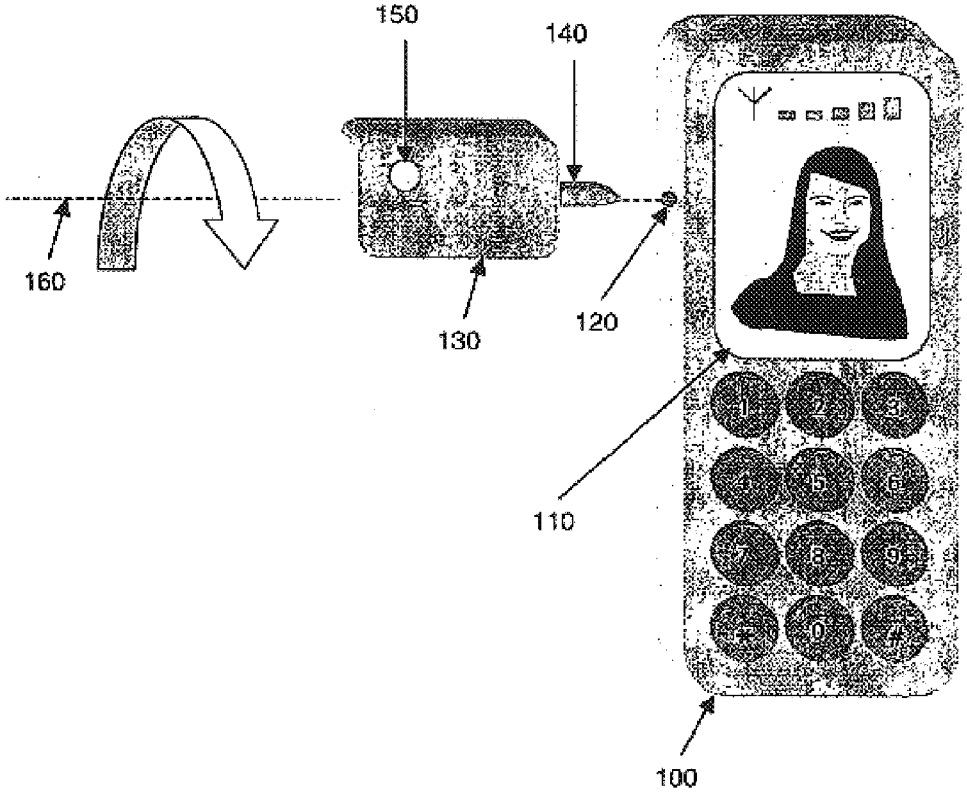
Figure 2:
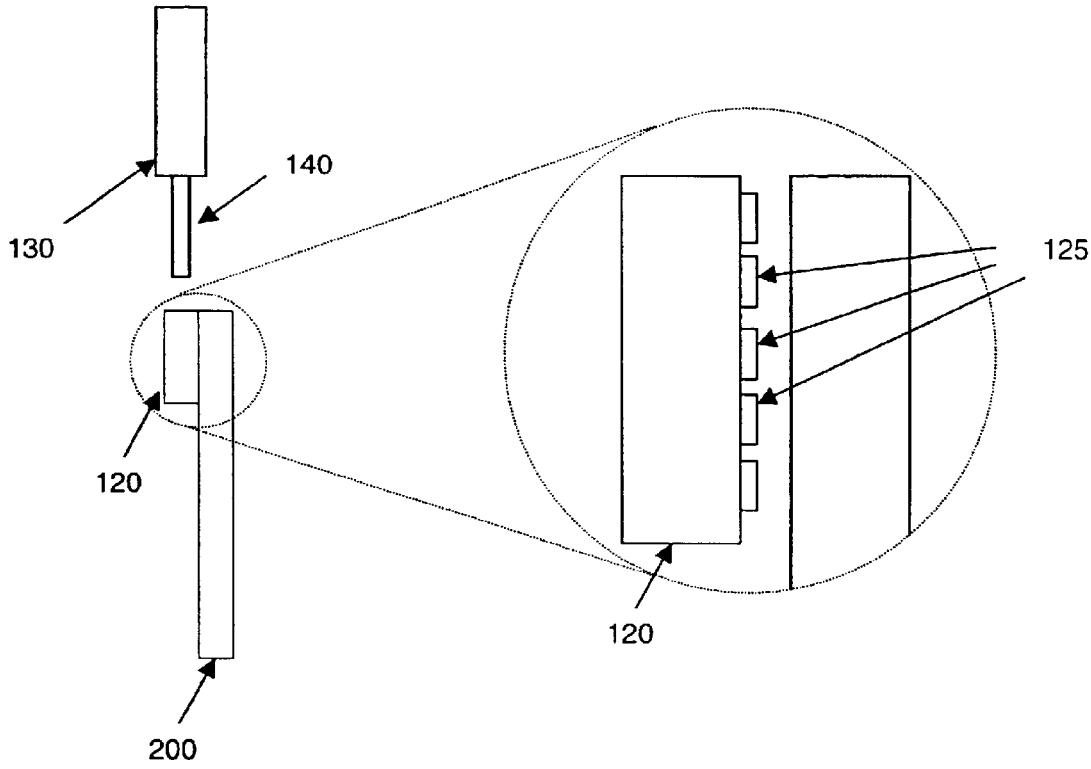
Figure 3:
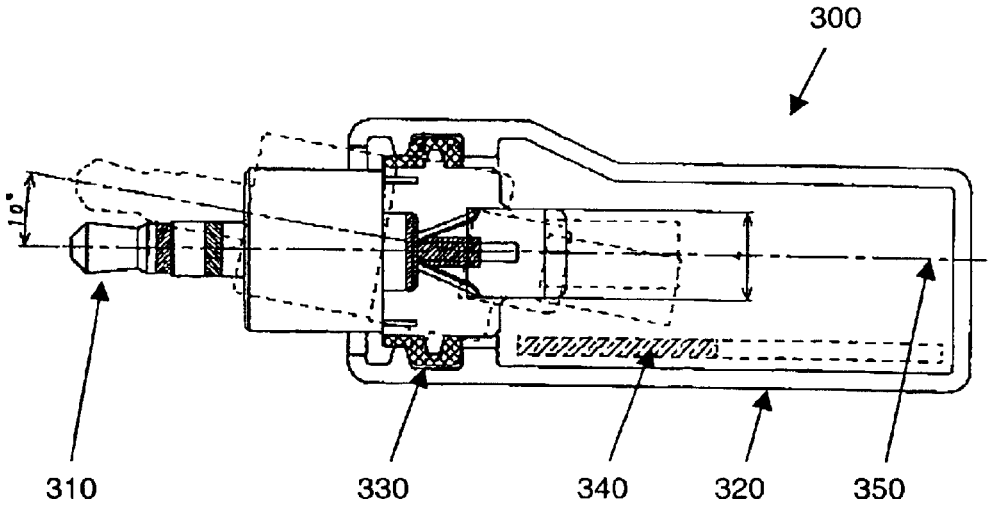

FIG. 1 shows a portable radio telephone together with a plug-in camera accessory;

FIG. 2 shows a connector located on a circuit board of the telephone of FIG. 1; and FIG. 3 shows a cross-sectional view of a camera accessory according to an embodiment of the invention.

FIG. 1 shows a telephone 100. The telephone may be configured for use on any communication network according to any communication standard, such as GSM, WCDMA or PDC.

The telephone 100 has a plurality of keys on its front panel as well as a display device 110. The display is arranged to inform the user of the status of the telephone, as well as display received or locally-generated images.

Local images may be generated by the camera accessory 130, which connects to the telephone via a socket 120 in the side of the telephone. Connections are made between circuitry in the camera accessory 130 and the telephone via the connector 140 which mates with corresponding connections in the socket 120.

The camera accessory has a lens 150 through which images may be captured. Circuitry in the camera accessory converts the analogue image data into digital data which is transferred to the telephone for local storage or transmission over a wireless link.

The camera 130 is powered from the battery of the telephone (not shown). The camera may be multi-functional and may be used to capture single images in the manner of a regular digital camera, or alternatively, it may be used to provide a streaming video signal for use in a videoconference. Such uses are dependent on a number of factors such as the specification of the camera, the telephone and the communication protocol in place between the telephone and a remote network.

The camera connector 140 is circular in cross section, and is arranged to allow the camera 130 to rotate about an axis 160. Such rotation permits the camera to be oriented so that the lens 150 is directed towards, or away from, the user. In the former position, the arrangement may be useful in videoconferencing, and in the latter position, it may be useful for proving snapshot images of a user's surroundings. In either position, the user is able to maintain the display 110 in a position where he can easily view it.

An advantage of providing the camera 130 as a separate unit is that the cost of the telephone can be kept at a lower level, and only those users who require video capability need to purchase the camera as an optional extra.

However, a disadvantage of such an arrangement is that the camera is positioned in a vulnerable position, and may be prone to damage from sudden knocks or impacts.

In particular, the connector socket 120 in the telephone is particularly susceptible to damage. In the example shown in FIG. 1, it comprises a circular multi-pole socket which is surface-mounted to the main circuit board in the telephone 120.

FIG. 2 shows a more detailed view of the socket 120 mounted on an internal circuit board 200 in the telephone 100. The main view of FIG. 2 shows a top plan view of the circuit board 200, with the socket 120 attached. The enlarged portion shows an exploded close-up view of the socket. In particular, the close-up view shows a number of pads 125, which are the means by which electrical and mechanical connection of the socket 120, to the circuit board 200, is achieved.

The pads 125 are small conductive areas on the lower surface of the socket 120. Each pad is internally connected to a particular pole of the socket 120, which in turn enables signals from the camera accessory 130 to pass to components on the circuit board 200.

The socket 120 is secured on the circuit board 200 by a soldering process. A suitable process involves printing solder paste onto portions of the circuit board to which components, including the socket 120, will be secured.

The components are then automatically positioned and the entire assembly is passed through an oven to melt the solder paste and secure all components in position. Thus, the socket is held in place by the solder between the pads 125 and similar structures on the circuit board 200. The solder also provides a good electrical connection.

The opening of the socket 120 is exposed through the housing of the telephone 100 such that the connector 140 of camera 130 may be inserted into the socket.

When the camera is attached in this manner, any stress applied to the camera may cause stress to be applied to the connections between the socket 120 and the circuit board 200. If the stress applied to the camera is of sufficient magnitude, then the socket 120 may be sheared from the circuit board 200. As the camera body 130 extends a relatively large distance from the telephone body, it may act as a lever, making it relatively easy to damage the connection between the socket 120 and the circuit board 200.

Any such damage to the connector 120 results in repairs being required before the camera accessory can be used again. Such repairs will require the telephone 100 to be out of service while the repairs are carried out. Such repairs are clearly undesirable and inconvenient for a user of the telephone.

To address the problem of damage being caused to the telephone through accidental force or pressure being applied to the camera 130, embodiments of the invention are arranged to absorb a certain amount of pressure and thus protect the socket 120 from possible damage.

FIG. 3 shows a cross-sectional view of a camera accessory 300 according to an embodiment of the invention. The camera 300 comprises a housing 320, in which is located a circuit board 340. The housing is manufactured from a plastics material, although other materials such as metals could also be used.

The circuit board 340 is populated with various components related to the camera's functionality, including an imaging module, an analogue to digital converter (ADC) and associated interface and driving circuitry. The imaging module receives image information via a lens, which is exposed, on the outer surface of the housing (not shown).

The circuit board 340 is electrically connected to the connector 310 by a number of flexible wires (not shown). The wires allow the signals generated by the camera accessory to be passed to the connector 310 and on to the telephone to which the camera is connected.

The housing 320 is of a two part construction. The upper part is formed from the part positioned above axis 350, and the lower part is formed from the part positioned below axis 350.

When the housing 320 is assembled, the connector 310, with a surrounding rubber bush, grommet or collar 330, is securely located within a shaped channel in the housing. The rubber bush is provided so that the connector 310 is free to move within the housing to a certain degree. The freedom of movement provided by the rubber bush is intended to limit any possible damage to the connected telephone in the event that the camera 300 is accidentally knocked by a user while it is connected to a telephone. In effect, the rubber bush acts as a shock absorber.

The electrical signals which are carried between the connector 310 and circuit board 340 by wires are not affected by any movement of the connector. The wires are arranged to flex in sympathy with movement of the connector and retain their connection with the fixed position circuit board 340.

The dotted representation of the connector 310 in FIG. 3 shows a typical extent of movement possible by the connector. In this embodiment, a displacement of 10° from a central axis 350 is possible. As the connector and bush are symmetrical about the axis 350, the displacement is possible in all directions i.e. all the possible positions of the connector define a cone.

The resilience provided by the bush, being made of a rubber or similarly resilient material, ensures that once any force applied to the camera 300 is removed, the connector returns to its position lying on the central axis 350.

Embodiments of the invention are thus able to provide a certain amount of protection to the connector on the circuit board. Any small blows to the camera, while it is connected to the telephone, will result in the rubber collar 330 absorbing the energy as the connector 310 is deflected.

Although described in terms of a plug-in camera accessory, the inventive concept may be employed in any accessory intended to be coupled with another device where some degree of shock absorption is required.

The present invention includes any novel feature or combination of features disclosed herein either explicitly or any generalisation thereof irrespective of whether or not it relates to the claimed invention or mitigates any or all of the problems addressed.

What is claimed is:

1. An assembly of an accessory and a portable electronic device comprising:

a housing;

a connector, extending from the housing, for electrically connecting the accessory to the portable electronic device by insertion into the electronic device; and circuitry located in the housing and electrically connected to the connector; and wherein the connector is mounted in the housing and moves in a lateral direction within the housing when an impulse is applied to the accessory in a lateral direction to absorb the impulse with the lateral direction having a component orthogonal to a direction of insertion of the connector into the electronic device; and the circuitry comprises a circuit board which moves laterally within the housing in response to the impulse applied laterally to the accessory.

2. An assembly as claimed in claim 1 wherein:

the connector is movable in all directions around a central axis.

3. An assembly as claimed in claim 1 wherein:

the connector is a circular multi-pole connector.

4. An assembly as claimed in claim 1 wherein:

the electronic device is a portable telephone.

5. An assembly in accordance with claim 1 comprising:

a shock absorber coupling the connector to the housing which absorbs the impulse applied in the lateral direction to the accessory.

6. An assembly as claimed in claim 5 wherein:

the connector is movable in all directions around a central axis.

7. An assembly as claimed in claim 5 wherein:

the accessory is rotatable about a longitudinal axis of the connector when connected to the electronic device.

8. An assembly as claimed in claim 5 wherein:

the shock absorber is a resilient collar.

9. An assembly as claimed in claim 8 wherein:

the resilient collar comprises a rubber material.

10. An assembly as claimed in claim 1 wherein:

the accessory is rotatable about a longitudinal axis of the connector when connected to the electronic device.

11. An assembly as claimed in claim 10 wherein:

the accessory is a camera device.

12. An assembly of an accessory and a portable electronic device comprising:

a housing;

a connector, extending from the housing, for electrically connecting the accessory to the portable electronic device by insertion into the electronic device; and a circuit board located in the housing and electrically connected to the connector; and a resilient collar engaging the connector which couples the connector to the housing to bias the connector within the housing to a first position when an impulse is not applied in a lateral direction to the accessory, the resilient collar permitting a component of lateral movement of the connector within the housing to other positions which absorbs an impulse applied in a lateral direction to the accessory; and wherein the lateral direction has a component orthogonal to a direction of the insertion of the connector into the electronic device.

13. An assembly in accordance with claim 12 wherein:

the resilient collar comprises a rubber material.

14. An assembly in accordance with claim 12 wherein:

the connector is movable in all directions around a central axis.

15. An assembly in accordance with claim 12 wherein:

the accessory is rotatable about a longitudinal axis of the connector when the connector is in the first position.

16. An assembly in accordance with claim 15 wherein:

the accessory is a camera.

17. An assembly in accordance with claim 16 wherein:

the connector is a jack which is received in a socket contained in the portable electronic device.

18. An assembly of an accessory and a portable electronic device comprising:

a housing;

a connector, extending from the housing, for electrically connecting the accessory to the portable electronic device by insertion into the electronic device; and circuitry located in the housing and electrically connected to the connector; and wherein the connector is mounted in the housing and moves within the housing when a shearing impulse is applied to the accessory to absorb the shearing impulse; and the circuitry comprises a circuit board which moves laterally within the housing in response to the shearing impulse applied to the accessory.

19. An assembly as claimed in claim 18 wherein:

the connector is movable in all directions around a central axis.

20. An assembly in accordance with claim 18 comprising:

a shock absorber coupling the connector to the housing which absorbs the shearing impulse applied to the accessory.

21. An assembly as claimed in claim 20 wherein:

the connector is movable in all directions around a central axis.

* * * * *